United States Patent [19]

Loftis

[11] 4,312,413

[45] Jan. 26, 1982

[54] DRILLING APPARATUS

[76] Inventor: James B. Loftis, P.O. Box 38, Remlap, Ala. 35217

[21] Appl. No.: 207,994

[22] Filed: Nov. 18, 1980

Related U.S. Application Data

[63] Continuation of Ser. No. 958,985, Nov. 9, 1978, abandoned.

[51] Int. Cl.[3] ..... E21B 7/02

[52] U.S. Cl. ..... 173/23; 173/140; 173/147; 175/52

[58] Field of Search ..... 173/23, 26, 140, 147; 175/52; 75/665 D

[56] References Cited

U.S. PATENT DOCUMENTS

| | | | |
|---|---|---|---|
| 2,483,017 | 9/1949 | McFeaters | 74/665 D X |
| 2,781,185 | 2/1957 | Robbins | 175/52 |
| 3,009,521 | 11/1961 | Failing | 173/140 |
| 3,012,619 | 12/1961 | Farque | 173/140 |
| 3,179,186 | 4/1965 | Bull | 173/140 |
| 3,328,976 | 7/1967 | Shoemaker et al. | 74/665 D X |
| 3,645,343 | 2/1972 | Mays | 173/23 X |
| 3,741,322 | 6/1973 | Wolters | 175/52 |
| 3,754,604 | 8/1973 | Inaba et al. | 173/28 |
| 3,835,940 | 9/1974 | Winter, Jr. | 175/52 X |
| 4,049,065 | 9/1977 | Walter | 173/23 X |

FOREIGN PATENT DOCUMENTS

| | | | |
|---|---|---|---|
| 231104 | 11/1960 | Australia | 173/26 |
| 516582 | 1/1940 | United Kingdom | 74/665 D |
| 160482 | of 1964 | U.S.S.R. | 173/23 |

*Primary Examiner*—Robert Mackey

*Attorney, Agent, or Firm*—Woodford R. Thompson, Jr.

[57] ABSTRACT

Drilling apparatus embodying an elongated boxed-in frame supporting a transmission unit for longitudinal movement therein with the transmission unit connecting a polygonal drive shaft to a driven head which is threadedly connected to a drill rod section. A first drive unit carried by the elongated frame has a drive shaft in axial alignment with one end of the polygonal shaft with the other end of the polygonal shaft being in axial alignment with the drive shaft of a second drive unit. The drive units exert torque concomitantly at opposite ends of the polygonal shaft to rotate both ends of the polygonal shaft in the same direction. The elongated frame is carried by a supporting frame mounted for rotation about a vertical axis on a translatable frame to position the driven head at selected angular positions about the vertical axis.

4 Claims, 5 Drawing Figures

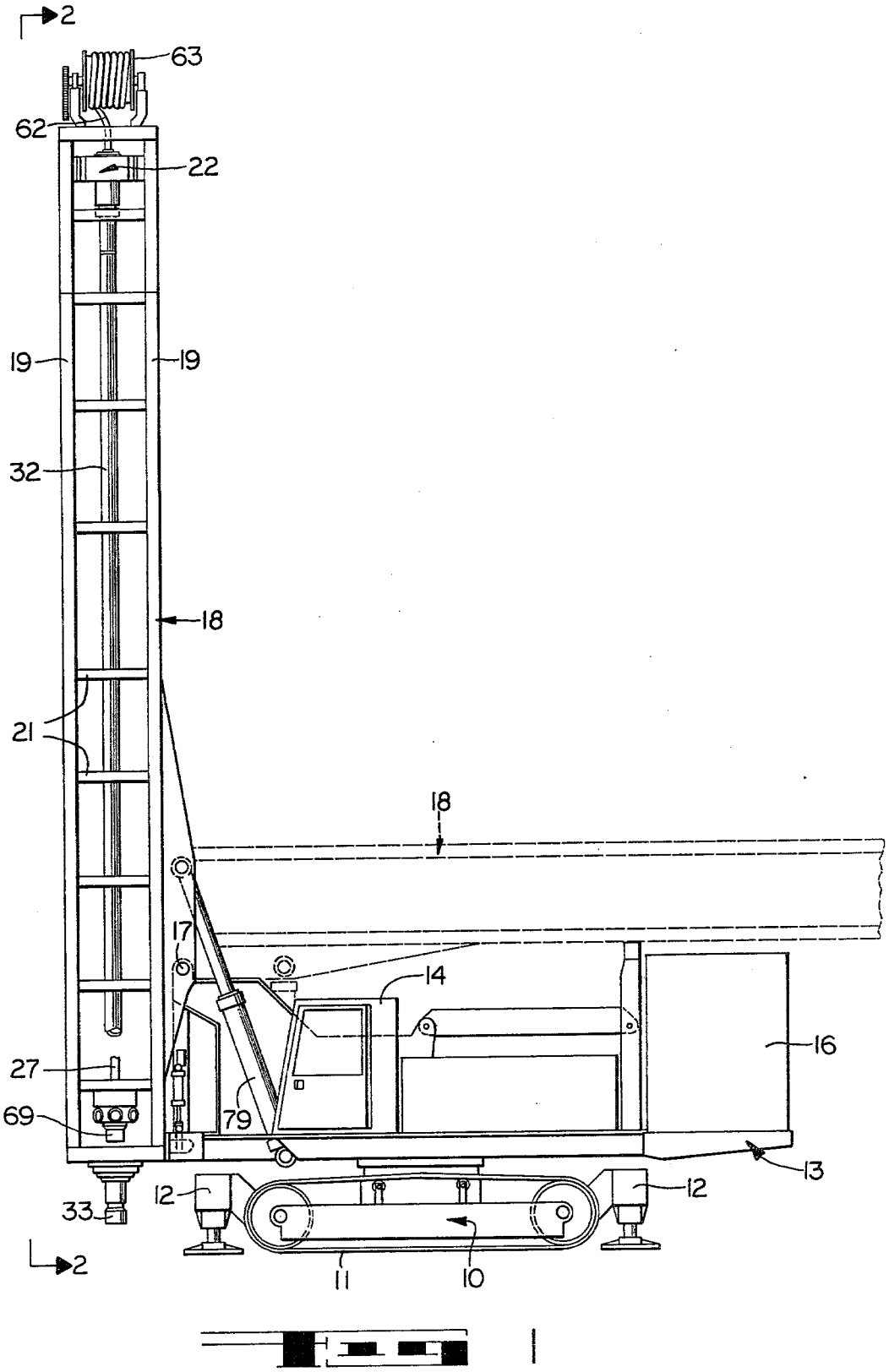
2
63
62
22
19
19
32
18
21
18
17
14
16
27
69
79
13
12
12
33
2
11
10
1

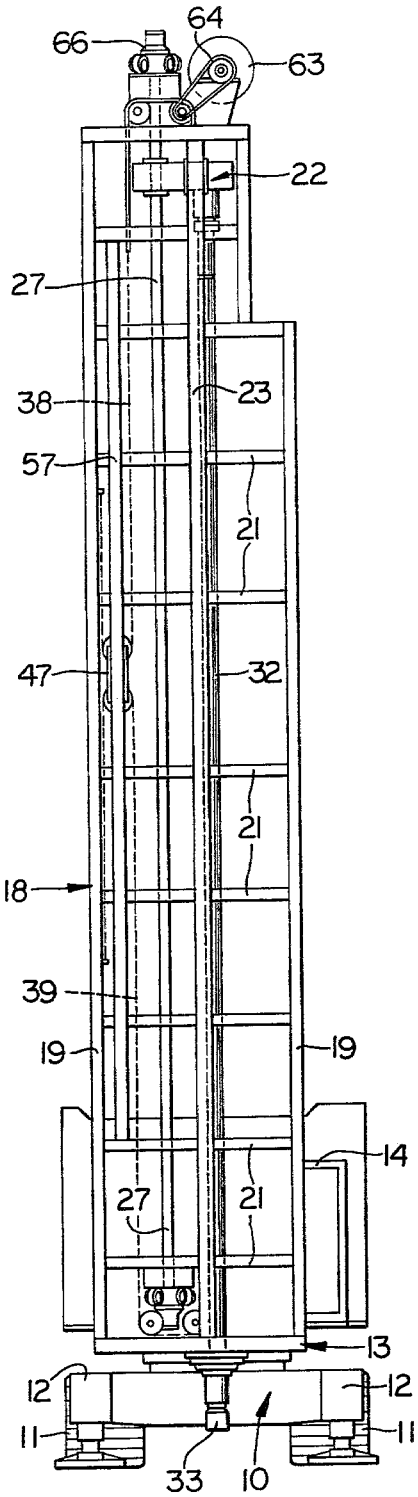
2
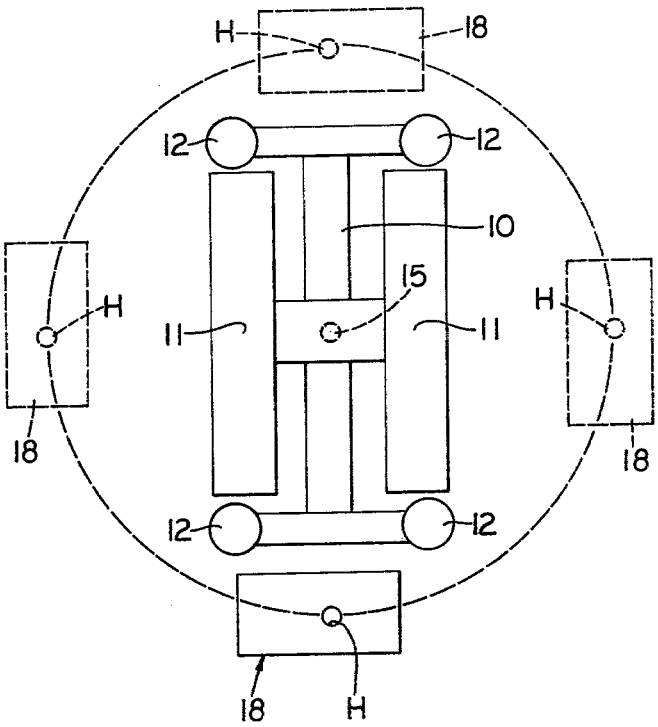
5

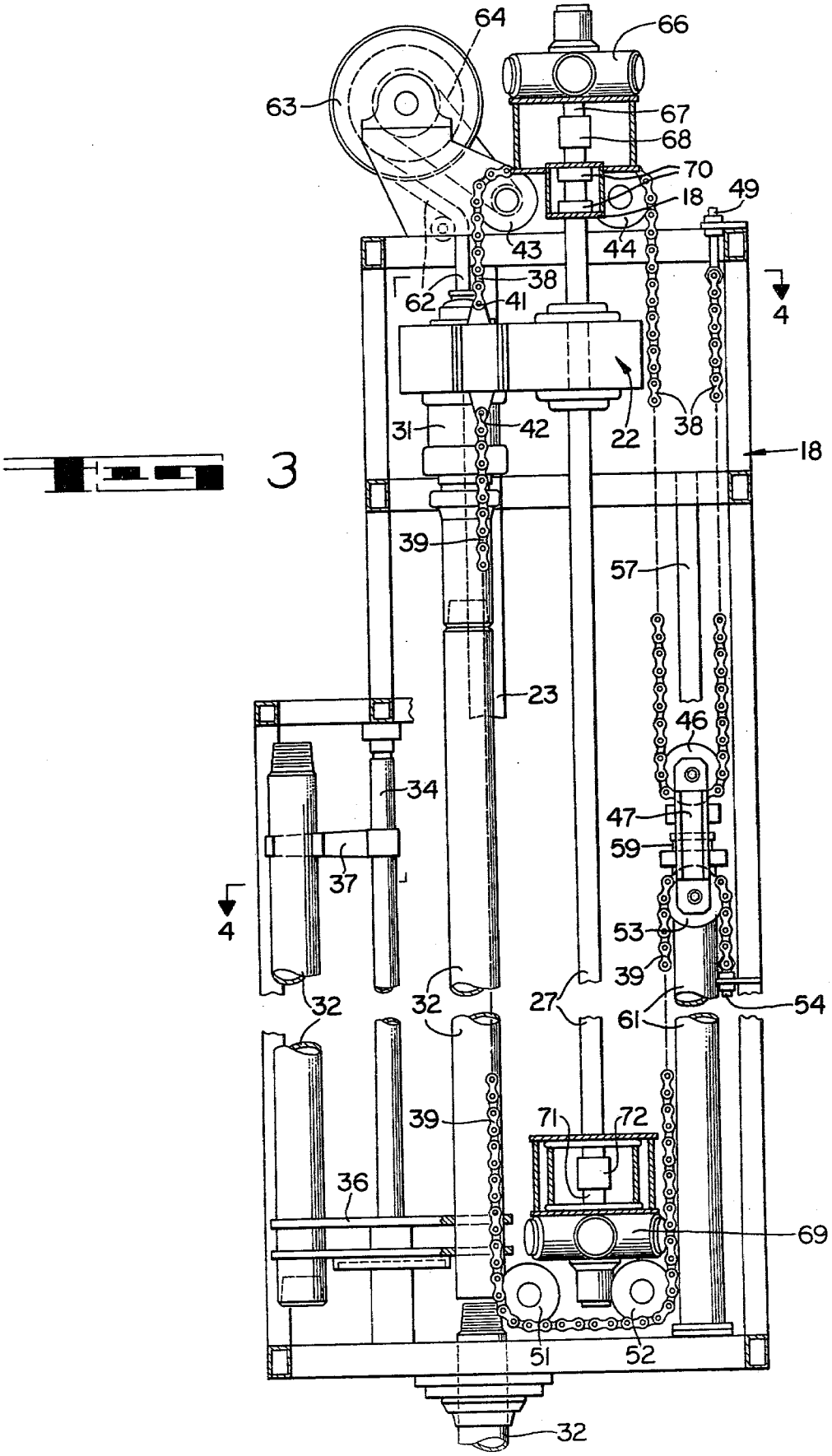
64
66
63
67
68
70
18
49
43
44
38
62
41
4
31
42
22
38
18
3
39
57
23
46
34
47
59
37
4
53
39
32
32
27
61
54
39
71
72
36
69
51
52
32

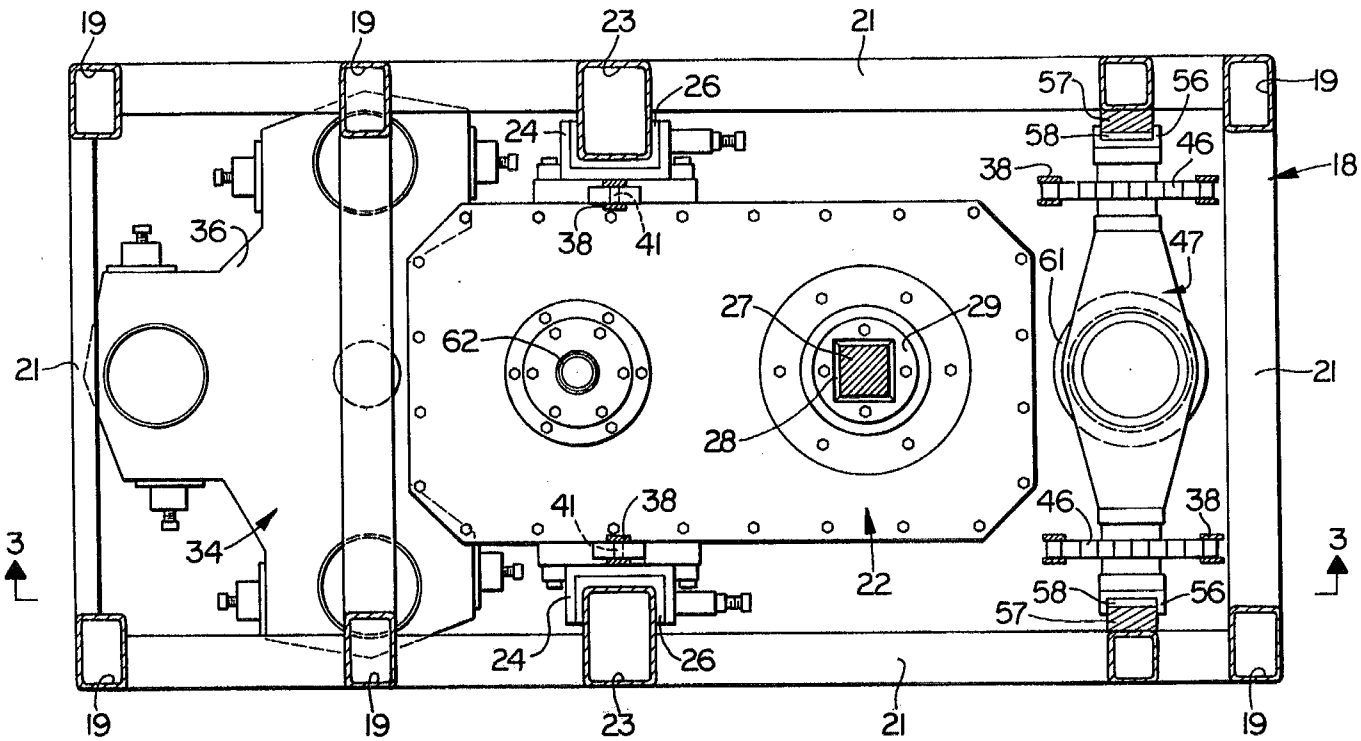
4

DRILLING APPARATUS

This is a continuation of application Ser. No. 958,985, filed Nov. 9, 1978, abandoned.

BACKGROUND OF THE INVENTION

This invention relates to drilling apparatus and more particularly to such apparatus which embodies an elongated frame which supports a transmission unit for longitudinal movement therein with the transmission unit connecting a polygonal drive shaft to a driven head which is threadedly connected to a drill rod section for drilling a hole into the earth.

Heretofore in the art to which my invention relates, power is imparted to one end only of the polygonal drive shaft whereby rotary motion is then transmitted through the transmission unit to a driven head operatively connected to a drill rod section. In view of the fact that the elongated frame and the polygonal drive shaft are both relatively long and a considerable amount of torque is applied to the driven end of the shaft, fatigue often occurs in the polygonal shaft and in the elongated supporting frame.

Difficulties have also been encountered in conventional type drilling apparatus having an elongated supporting frame with means for transmitting rotary motion from a polygonal drive shaft through a transmission to the drill rod sections due to the fact that all operating parts, including the polygonal shaft and transmission are exposed whereby the apparatus is not only hazardous to the operators of the drill but the various components of the drive mechanism are unprotected whereby they may be easily damaged.

Furthermore, difficulties have been encountered with conventional type drilling apparatus due to the fact that it has been the usual practice to erect the drilling apparatus at a location to drill a single hole downwardly into the earth whereupon the entire apparatus is then moved to the next location where the next hole is drilled. This operation consumes a considerable amount of time and effort due to the fact that the translatable frame which supports the drilling apparatus must be moved to each separate location whereupon its supporting jacks are then extended to support the apparatus in a level position for drilling. Also, the distance between each drilling site must be accurately measured prior to moving the drilling apparatus from one drilling site to the next.

SUMMARY OF THE INVENTION

To overcome the above and other difficulties, I provide drilling apparatus which comprises an elongated, boxed-in vertical frame which supports within the confines thereof the operating components for raising, lowering and rotating the drill rod sections, thus providing protection for the drill operator and at the same time preventing damage to the working components. A transmission unit is supported for longitudinal movement within the frame and operatively connects a vertical polygonal drive shaft to a driven head which in turn is threadedly connected to a drill rod section. To eliminate fatigue in the elongated frame and in the polygonal drive shaft during the drilling operation, a first drive unit carried by the elongated frame has a vertical drive shaft in axial alignment with one end of the polygonal shaft with the other end of the polygonal shaft being in axial alignment with the vertical drive shaft of a second drive unit. Accordingly, the drive units exert torque concomitantly at opposite ends of the polygonal shaft to thus provide a balanced drive with the power for driving the polygonal drive shaft being supplied substantially equally by the drive units mounted at opposite ends of the polygonal shaft. Accordingly, the stresses imparted to the elongated, boxed-in frame are applied adjacent each end of the elongated frame rather than being applied at only one end thereof.

To facilitate movement of the drill rod section from one drill site to another, the elongated frame is carried by a supporting frame which is mounted for complete orbital rotation about a vertical axis on a translatable frame. Accordingly, with my improved apparatus, it is not necessary to measure and mark the individual locations at which all of the holes are to be drilled into the earth. That is, the translatable frame is moved to a predetermined location and erected in a level position by its jacks. The supporting frame for the elongated frame is then moved to selected angular positions about its vertical axis of rotation on the translatable frame whereby a plurality of holes may be drilled into the earth while the translatable frame is at a single location.

DESCRIPTION OF THE DRAWINGS

Apparatus embodying features of my invention is illustrated in the accompanying drawings, forming a part of this application, in which:

FIG. 1 is a side elevational view showing the apparatus in position to drill a hole vertically into the earth, the drill rod sections carried thereby being omitted for the sake of clarity;

FIG. 2 is a front elevational view taken generally along the line 2—2 of FIG. 1, the drill rod rack and the drill rod sections carried thereby being omitted for the sake of clarity;

FIG. 3 is an enlarged, sectional view taken generally along the line 3—3 of FIG. 4;

FIG. 4 is a transverse, sectional view taken generally along the line 4—4 of FIG. 3; and, FIG. 5 is a diagrammatic view showing the fixed position of the translatable frame and the various locations of the elongated, boxed-in frame as the rotatable, supporting frame is moved to selected angular positions relative to the translatable frame.

DETAILED DESCRIPTION

Referring now to the drawings for a better understanding of my invention, I show a translatable frame 10 which may be in the form of a heavy duty tractor-type vehicle having endless tracks 11. The translatable frame 10 is supported at selected, fixed positions by adjustable jack units 12 whereby the translatable frame may be adjusted to a level position by operating the jack unit 12 in a manner well understood in the art to which my invention relates.

The translatable frame 10 carries a rotatable, supporting frame 13 which is adapted for complete orbital rotation in a horizontal plane about a vertical axis whereby the supporting frame 13 may be moved to selected angular positions relative to the translatable frame 10. The supporting frame 13 is provided with a conventional cab 14 for an operator. The controls, such as valves, switches and the like are all mounted within the cab 14 in a conventional manner whereby the apparatus may be manipulated from the cab 14. The supporting frame 13 also carries a compressor unit, indicated generally at 16 for supplying compressed air downwardly through the drill rod sections whereby cuttings are picked up by the air and conveyed upwardly between the drill rod sections and the hole being bored and are then discharged adjacent the surface of the ground in the usual manner. That is, the cuttings are removed from the hole being bored in a manner similar to that disclosed in the Robbins U.S. Pat. No. 2,781,185. Since such apparatus is well known in the art to which my invention relates, no further description thereof is deemed necessary.

Mounted for pivotal movement about pivot pins 17 adjacent the forward end of the supporting frame 13 is an elongated boxed-in vertical frame 18 which is generally rectangular, as clearly shown in FIG. 4. The elongated frame 18 comprises a plurality of vertically extending frame members 19 which are secured rigidly to each other by a plurality of horizontal frame members 21. Accordingly, the frame members 19 and 21 provide rigid members at all four sides of the boxed-in frame 18.

Mounted for longitudinal movement within the elongated frame 18 is a transmission unit 22. The elongated frame 18 is provided with vertically extending guide members 23 at opposite sides of the transmission unit 22 in position to be engaged by generally U-shaped guide members 24 carried by the transmission unit 22. To reduce friction between the guide members 24 and the vertical guide members 23, generally U-shaped members 26 formed of a low friction material are inserted between the members 23 and 24. The low friction material 26 may be in the form of tetrafluoroethylene, sold under the trade name "TEFLON". The transmission unit 22 is driven by a polygonal vertical drive shaft 27 which extends through and slidably engages an opening 28 provided in a drive member 29 of the transmission unit 22 whereby the transmission unit 22 is adapted for axial movement along the polygonal shaft 27 as the polygonal shaft 27 drives the rotary member 29. The rotary member 29 is operatively connected to a driven head 31 whereby the driven head 31 rotates one revolution each time the rotary member 29 rotates one revolution. The driven head 31 is adaped to be threadedly connected to one end of an adjacent drill rod section 32 extending in axial alignment therewith, as shown in FIG. 3. The other end of the drill rod section 32 is threadedly connected selectively to another drill rod section 32 and to a drill bit 33 for drilling a hole into the earth. The drill bit may be of a conventional type, such as that shown in the Robbins U.S. Pat. No. 2,781,185. The drill rod sections 32 are carried by a rotatable drill rod rack, indicated generally at 34, whereby the drill rod section 32 may be positioned sequentially in axial alignment with the driven head 31. The drill rod rack 34 is provided with a horizontally extending drill rod support unit 36 which is adapted to support a plurality of angularly spaced drill rod sections 32 in position to be positioned sequentially beneath the driven head 31. The upper ends of the drill rod sections 32 are held in the drill rod rack 34 by suitable retainer members 37.

The transmission unit 22 is moved longitudinally of the elongated frame 18 by up-pull chains 38 and down-pull chains 39 which are connected by suitable pins 41 and 42, respectively, to opposite sides of the transmission unit, as shown in FIG. 3. Each up-pull chain 38 passes over upper sprockets 43 and 44 and then downwardly where it passes under a sprocket 46 of a chain traveler assembly indicated generally at 47. After passing under the sprocket 46, each up-pull chain 38 extends upwardly toward the upper end of the elongated frame 18 where it is attached thereto by a suitable retainer member 49. Each down-pull chain 39 extends downwardly and passes beneath lower sprockets 51 and 52 whereupon it then extends upwardly and passes over a sprocket 53 which is also carried by the chain traveler assembly 47. After passing over the sprocket 53, each down-pull chain 39 extends downwardly and is secured to the elongated frame by a suitable retainer member 54. The chain traveler assembly 47 extends transversely of the elongated frame 18, as shown in FIG. 4. Opposite ends of the chain traveler assembly 47 carry channel-like guides 56 which slidably engage vertically extending guides 57 carried by the elongated frame 18. The guides 56 carry anti-friction members 58 which engage the channel guides 56, as shown in FIG. 4. The anti-friction members 58 may be formed of a suitable material such as tetrafluorethylene. As shown in FIGS. 3 and 4, an upper pull chain 38 and the sprockets 43, 44 and 46 associated therewith are provided at each side of the elongated frame 18 and are actuated by the chain traveler assembly 47. In like manner, a lower pull chain 39 and its associated sprockets 51, 52 and 53 are provided at opposite sides of the elongated frame 18 and are also actuated by the chain traveler assembly 47.

The chain traveler assembly 47 is connected to the upper end of a piston rod 59 carried by a fluid pressure operated cylinder 61 which is carried by the elongated frame 18, as shown in FIG. 3. Accordingly, each time the piston rod 59 is retracted by the fluid pressure operated cylinder 61, the sprockets 46 are moved downwardly to thus move the chains 38 in a direction to exert an upward pull on the transmission unit 22. On the other hand, upon extending the piston rod 59, the sprockets 53 are moved upwardly to thus pull the chain 39 in a direction to exert a downward pull on the transmission unit 22.

Air under pressure is supplied to the drill rod sections 32 through the driven head 31 by a flexible conduit 62 which is carried by a conventional reel unit indicated generally at 63. The reel 63 is operatively connected to the sprocket 43 by a pulley 64 whereby the conduit 62 is extended and retracted in response to raising and lowering the transmission unit 22 and the driven head 31 carried thereby. Air under pressure is supplied to the conduit 62 by the compressor 16. In view of the fact that the means for supplying air under pressure to the drill rod sections 32 is well known in the art to which my invention relates, no further description is deemed necessary.

A first drive unit 66 is mounted at the upper end of the elongated frame 18 and carries a centrally disposed, vertically depending drive shaft 67 which is in axial alignment with the upper end of the polygonal shaft 27. The drive shaft 67 is connected in driving relation with the upper end of the polygonal shaft 27 by a suitable connector 68 and is supported by a conventional bearing unit 70, as shown in FIG. 3. A second drive unit 69 is mounted adjacent the lower end of the elongated frame 18 and carries a centrally disposed vertical drive shaft 71 which is in axial alignment with the polygonal shaft 27. The drive shaft 71 is connected to the polygonal shaft 27 by a suitable connector 72. The drive units 66 and 69 exert torque concomitantly at opposite ends of the polygonal shaft 27 to rotate both ends of the polygonal shaft in the same direction whereby substantially one-half the torque is applied to opposite ends of the polygonal shaft thus reducing shock, backlash and vibration which in turn provides longer life throughout all of the mechanical drives and the hydraulic system for the drilling apparatus. That is, the hydraulic fluid is kept cool and vibration is kept out of the elaborate hydraulic system, which results in a tremendous savings in parts, maintenance and down time. This not only reduces the stresses applied at the end of the polygonal shaft but also reduces the stresses applied at the end of the elongated frame 18, thereby eliminating fatigue in the polygonal shaft and the elongated frame. That is, a balanced drive is provided whereby all of the driving torque is not exerted at either end of the elongated frame. Preferably, the means connecting the first drive unit 66 and the second drive unit 69 in driving relation with the polygonal shaft 27 are also operable independently of each other whereby the torque may be selectively exerted concomitantly at both ends of the polygonal shaft 27 and at either end of the polygonal shaft 27. That is, should one drive unit fail while in use, the drilling apparatus could be operated by the other drive unit until the necessary repairs could be made. By providing a centrally disposed shaft for each of the drive units 66 and 69, each drive shaft 67 and 71 is at the center of mass of its drive unit whereby each drive assembly is dynamically balanced.

As shown in FIG. 5, the translatable frame 10 is supported in a fixed, level position by the adjustable ground engaging jacks 12 whereby the rotatable frame 13 and the elongated frame 18 carried thereby are adapted for rotation to selected angular positions relative to the fixed, translatable frame 10. In FIG. 5, elongated frame 18 is shown diagrammatically as being fixedly supported at one location in solid lines, with angularly spaced locations being indicated in dotted lines. That is, in FIG. 5, we show the drilling apparatus as being adapted to drill four angularly spaced holes H into the ground from a single location of the translatable frame 10.

In operation, the translatable frame 10 is moved to a predetermined location and is fixedly supported by the ground engaging jacks 12. Where it is desired to position the drilled holes an angular distance of 90° from each other, the elongated frame 18 is moved to the solid line position shown in FIG. 5 and a hole H is drilled at this location. The drill rod sections are then removed from the hole whereupon the rotatable frame 13 is then rotated an angular distance of 90° and a second hole H is then drilled. This procedure is repeated until all four holes have been drilled. It will be understood that the holes H could be drilled at other angularly spaced locations relative to each other while the translatable frame 10 is supported in a selected, fixed position.

To transport the apparatus from one drill location to another, the elongated frame 18 is adapted to move from the solid line position shown in FIG. 1 to the dotted line position whereby the elongated frame extends in a generally horizontal plane above the rotatable frame 13. This is accomplished by a fluid pressure operated unit 79 which extends between the elongated frame 18 and the rotatable frame 13. The adjustable jacks 12 are then moved out of engagement with the ground whereby the entire apparatus may be moved to another location for drilling another set of angularly spaced holes into the ground from the new location of the translatable frame 10.

From the foregoing, it will be seen that I have devised improved drilling apparatus for drilling a plurality of angularly spaced holes downwardly into the earth from a single location of the translatable frame on which the apparatus is transported. By mounting the drive units for the polygonal shaft at opposite ends of the elongated frame and in axial alignment with opposite ends of the polygonal shaft, the driving torque is exerted concomitantly at opposite ends of the polygonal shaft to thereby rotate both ends of the polygonal shaft in the same direction. Accordingly, I provide a balanced drive whereby the driving torque is distributed equally at opposite ends of the polygonal shaft and at opposite ends of the elongated frame. Also, by providing drive shafts for the drive units which are centrally disposed, each drive shaft is at the center of mass of its drive unit whereby each drive assembly is dynamically balanced.

Furthermore, by providing a boxed-in frame which completely encases the working components of the means for raising, lowering and rotating the drill rod sections, I provide apparatus which is safe in operation and also protects such working parts from damage.

While I have shown my invention in but one form, it will be obvious to those skilled in the art that it is not so limited, but is susceptible of various changes and modifications without departing from the spirit thereof.

What I claim is:

1. The combination with drilling apparatus having a relatively long elongated vertical frame supporting a transmission unit for longitudinal movement therein with the transmission unit operatively connecting a longitudinally extending polygonal vertical drive shaft to a driven head disposed to be threadedly connected to one end of an adjacent drill rod section extending in axial alignment therewith with the other end of the drill rod section being threadedly connected selectively to another drill rod section and a drill bit for drilling a hole into the earth, the improvement in means for driving said polygonal vertical shaft and supporting said elongated frame, comprising:

(a) an upper drive unit carried by the upper end of said elongated frame and having a centrally disposed vertical drive shaft at the center of mass of said drive unit and in axial alignment with one end of said polygonal vertical shaft, (b) a lower drive unit carried by the lower end of said elongated frame and having a centrally disposed vertical drive shaft at the center of mass of said drive unit and in axial alignment with the other end of said polygonal vertical shaft, (c) bearing support means connecting said upper drive unit in driving relation with said upper end of said polygonal vertical shaft for rotating said polygonal shaft in one direction, (d) means connecting said lower drive unit in driving relation with said lower end of said polygonal vertical shaft for rotating said polygonal shaft in said one direction so that torque is exerted concomitantly at opposite ends of said polygonal shaft to drive said polygonal shaft in said one direction, (e) a translatable frame supporting said elongated vertical frame for complete orbital rotation about a vertical axis so that said elongated frame is rotatable to position said driven head and the drill rod section threadedly connected thereto at selected angular positions about said vertical axis whereby a plurality of angularly spaced holes may be drilled into the earth while said translatable frame is at a single fixed position, and (f) ground engaging adjustable jacks carried by said translatable frame for supporting said translatable frame at said single location while said elongated frame is rotated to said selected angular position.

2. The combination as defined in claim 1 in which said means connecting said upper drive unit and said lower drive unit in driving relation with said polygonal shaft are also operable independently of each other so that said torque may be selectively exerted concomitantly at both ends of said polygonal shaft and at either end of said polygonal shaft.

3. The combination as defined in claim 1 in which said elongated frame is generally rectangular as viewed in cross section to define a boxed-in frame which completely encloses said transmission unit, said polygonal drive shaft, said driven head, said upper and lower drive units and a drill rod rack.

4. The combination as defined in claim 3 in which spaced apart, longitudinally extending guide members are carried by said elongated frame in position to engage guide members carried by said transmission unit.

* * * * *